United States Patent [19]

Suzuki et al.

[11] Patent Number: 4,874,264

[45] Date of Patent: Oct. 17, 1989

[54] SELECTIVE MAGNETIC ATTACHMENT OF A PRINT HEAD TO A DRIVE BELT

[75] Inventors: Takami Suzuki; Yoshikuni Tatara, both of Yokohama; Tomoyuki Moriya, Hiratsuka, all of Japan

[73] Assignee: Ricoh Company, Ltd., Tokyo, Japan

[21] Appl. No.: 86,956

[22] Filed: Aug. 19, 1987

Related U.S. Application Data

[63] Continuation of Ser. No. 935,300, Nov. 26, 1986, abandoned, which is a continuation of Ser. No. 609,500, May 11, 1984, abandoned.

[30] Foreign Application Priority Data

| | | | |
|---|---|---|---|
| May 12, 1983 | [JP] | Japan | 58-83254 |
| Aug. 20, 1983 | [JP] | Japan | 58-150957 |
| Aug. 25, 1983 | [JP] | Japan | 58-154035 |
| Aug. 31, 1983 | [JP] | Japan | 58-157788 |
| Sep. 9, 1983 | [JP] | Japan | 58-165029 |

[51] Int. Cl.[4] ..... B41J 19/56

[52] U.S. Cl. ..... 400/335; 400/82; 400/320; 400/322; 400/356; 400/645.1

[58] Field of Search ..... 400/82, 248, 642, 643, 400/644, 645, 645.1, 645.2, 645.3, 645.4, 645.5, 320, 322, 352, 353, 354, 355, 356, 357, 335, 16, 17, 18, 19, 20, 21, 22, 144.2, 149; 346/46, 76 PH, 139 C

[56] References Cited

U.S. PATENT DOCUMENTS

| | | | |
|---|---|---|---|
| 432,298 | 7/1890 | Blickensderfer | 400/20 |
| 1,174,555 | 3/1916 | Fowler | 400/645.1 |
| 2,582,412 | 1/1952 | Bosquet | 400/21 |
| 3,576,582 | 4/1971 | Smith, Jr. | 346/46 |
| 4,204,779 | 5/1980 | Lee et al. | 400/82 |
| 4,444,519 | 8/1984 | Howell et al. | 400/82 |
| 4,459,054 | 7/1984 | Dollenmayer | 400/144.2 |
| 4,475,826 | 10/1984 | Durr et al. | 400/352 |
| 4,488,159 | 12/1984 | Fujiwara et al. | 346/49 |
| 4,498,792 | 2/1985 | Falconieri | 400/248 |
| 4,527,918 | 7/1985 | Yamamoto et al. | 400/17 |

FOREIGN PATENT DOCUMENTS

| | | | |
|---|---|---|---|
| 29886 | 6/1981 | European Pat. Off. | 400/144.2 |
| 3238165 | 4/1983 | Fed. Rep. of Germany | 400/144.2 |
| 5802 | 1/1980 | Japan | 400/18 |
| 5775 | 1/1981 | Japan | 400/144.2 |
| 101857 | 8/1981 | Japan | 400/320 |
| 12666 | 1/1982 | Japan | 400/82 |
| 12673 | 1/1982 | Japan | 400/82 |
| 89377 | 5/1983 | Japan | 400/82 |
| 128859 | 8/1983 | Japan | 400/82 |
| 2108049 | 5/1983 | United Kingdom | 400/248 |

OTHER PUBLICATIONS

J. W. Mink; "Compact, Flat-Bed/Display Typewriter"; *IBM Tech. Disc. Bull.,* vol. 25, No. 7A, pp. 3196–3197; Dec. 1982.

J. H. Jennings et al.; "Self-Aligning Belt Clamp Mechanism"; *IBM Tech. Disc. Bull.;* vol. 26, No. 3B, pp. 1578–1579; Aug. 1983.

*Primary Examiner*—David A. Wiecking

*Attorney, Agent, or Firm*—Cooper & Dunham

[57] ABSTRACT

A hybrid printer includes at least one impact type print head and at least one non-impact type print head, which are selectively used to print not only graphic information but also character information. For example, the impact type print head may be a type wheel print head and the non-impact type print head may be a pen print head. The print heads are selectively magnetically coupled to the carriage drive belt.

7 Claims, 18 Drawing Sheets

SELECTIVE MAGNETIC ATTACHMENT OF A PRINT HEAD TO A DRIVE BELT

This is a continuation of application Ser. No. 935,300, filed Nov. 26, 1986, which in turn is a continuation of application Ser. No. 609,500 filed May 11, 1984, both now abandoned.

BACKGROUND OF THE INVENTION

1. Field of the Invention

This invention relates to a printer including a platen roller for guiding the advancement of a sheet of paper to be printed and a carriage which has a print head mounted thereon and which is supported to be movable along the platen roller in a reciprocating manner. More particularly, the present invention relates to a hybrid printer including a plurality of print heads, such as a type wheel print head and a pen print head, mounted on the carriage, thereby allowing versatile printing operations.

2. Description of the Prior Art

In pen recorders, high quality pictorial images and graphs can be printed, and, furthermore, multicolor printing can be carried out with ease by simply using two or more pens with inks different in color. However, pen recorders are disadvantageous in printing characters and symbols because if characters are to be printed by a pen recorder, it will require an exorbitant amount of time and the quality of imprints will generally be poor. On the other hand, there are those printers which are more suited to be used in printing characters and symbols and they include impact printers, such as a wheel printer using a type wheel, and dot printers, such as a thermal printer using a thermal print head. Those printers, however, are not suitable for drawing pictures and graphs. It it often desired that graphic information such as pictures and graphs is to be printed together with descriptive information. In such a case, it is very convenient if a printer is provided with a graphic printing function as well as a character printing function, because the graphic and descriptive information can be printed without interruption.

Under the circumstances, there has been proposed a hybrid printer capable of printing graphic information as well as descriptive information. This prior art hybrid printer, however, was so structured that a pen and a type wheel could be mounted interchangeably on a single print head. In this case, an operator must change the printing device from one kind to the other when the information to be printed changes from one kind to the other. Therefore, the prior art hybrid printer was inconvenient to use.

SUMMARY OF THE INVENTION

It is therefore a primary object of the present invention to provide an improved hybrid printer.

Another object of the present invention is to provide a hybrid printer which is particularly convenient and easy to use.

A further object of the present invention is to provide a hybrid printer including a plurality of print heads, preferably different in kind, which are selected for use automatically.

A still further object of the present invention is to provide a hybrid printer capable of printing graphic and descriptive information without interruption.

A still further object of the present invention is to provide a high-speed hybrid printer.

Other objects, advantages and novel features of the present invention will become apparent from the following detailed description of the invention when considered in conjunction with the accompanying drawings.

DESCRIPTION OF THE PREFERRED EMBODIMENTS

Figure 1:
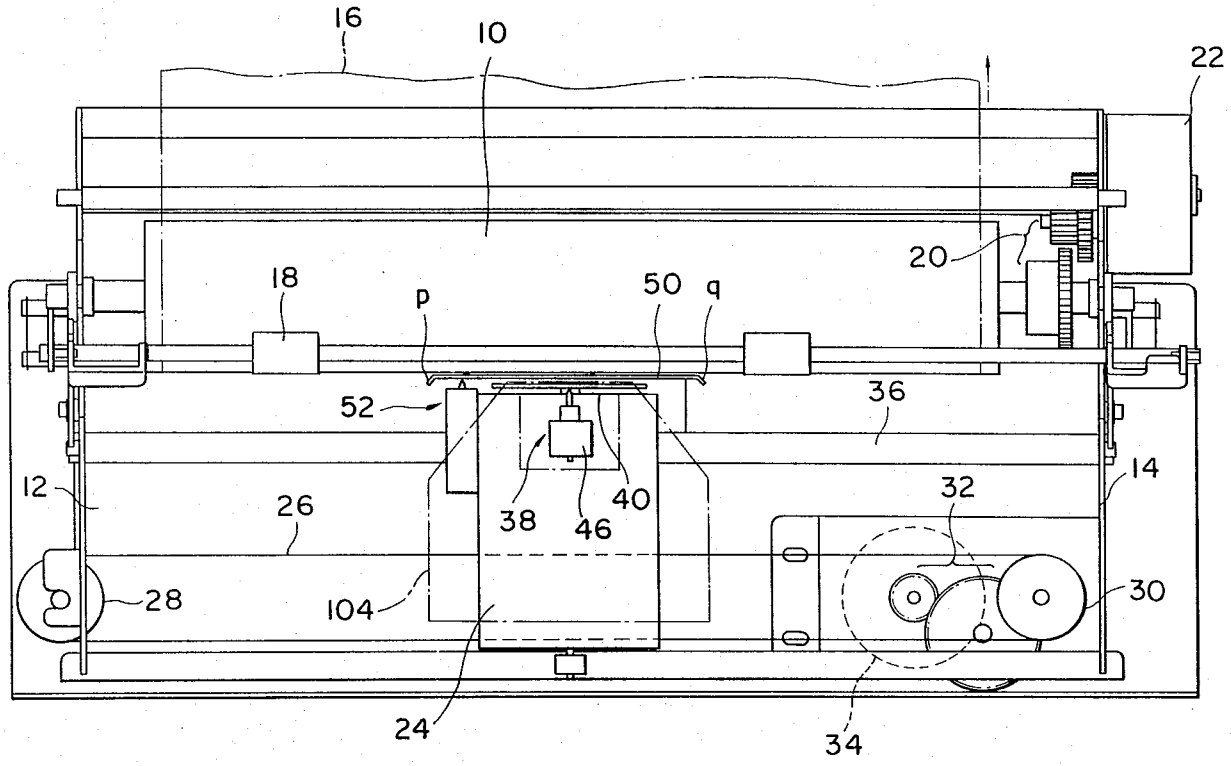
FIG. 1 is a plan view schematically showing a hybrid printer provided with a type wheel print head and a pen print head constructed in accordance with one embodiment of the present invention.

Referring now to FIG. 1, there is shown a hybrid printer constructed in accordance with one embodiment of the present invention. As shown, the printer includes a platen roller 10 which is journaled to a pair of side plates 12 and 14 defining part of a housing or frame of the printer. A sheet of paper 16 to be printed is placed around and pressed against the platen roller 10 by means of pressure rollers 18. The platen roller 10 is operatively coupled to a reversibly rotatable line feed motor 22 through a gear train 20. Thus, the platen roller 10 may be driven to rotate in either direction according to the driving direction of the line feed motor 22. When the line feed motor 22 is driven to rotate in the normal direction, the platen roller 10 rotates to cause the sheet of paper 16 to advance forward as indicated by the arrow.

The printer also includes a carriage 24 which is disposed in front of the platen roller 10. Also provided is an endless belt 26 as extended between a pair of pulleys 28 and 30, and the carriage 24 is fixedly connected to the endless belt 26. The pulley 30 is operatively coupled to a carriage drive motor 34 through a gear train 32. The motor 34 is a reversibly rotatable motor and thus the carriage 24 is driven to move along the platen roller 10 as guided by a guide shaft 36, which extends in parallel with the platen roller 10, in a reciprocating manner depending upon the direction of rotation of the motor 34.

Figure 2:
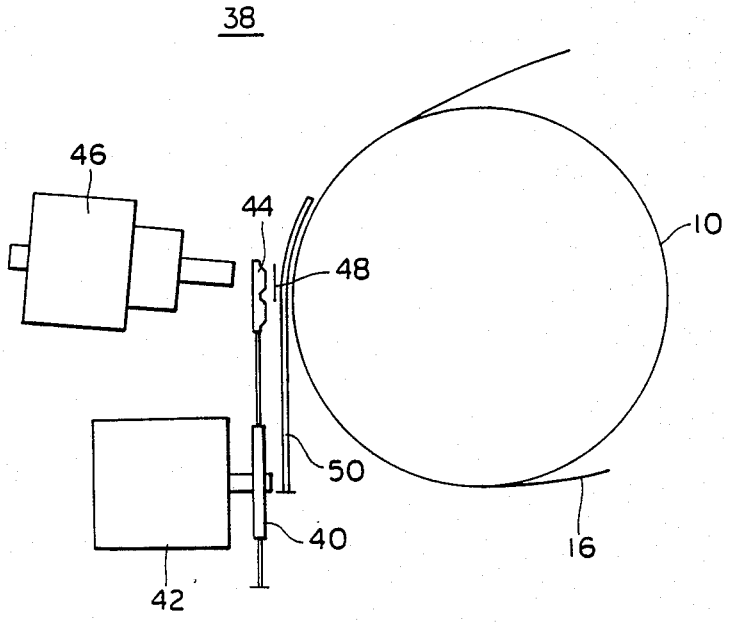
FIG. 2 is a schematic illustration showing the structure of the type wheel print head in the printer of FIG. 1.

An impact type print head 38 is provided as mounted on the carriage 24 located centrally at one side thereof. The illustrated example is a so-called type wheel print head as shown in FIG. 2. That is, the type wheel print head includes a type wheel 40 which is rotatably supported by a selection motor 42 which in turn is fixedly mounted on the carriage 24. As well known in the art, the type wheel 40 is comprised of a hub, a plurality of spokes extending radially from the hub and a plurality of types 44 provided at the free ends of the spokes. It is to be noted that one or more of the spokes may be provided with two or more types as arranged radially, or none. The selection motor 42 is driven to rotate to locate a selected one of the types carried by the type wheel 40 at a predetermined printing position. The type wheel print head also includes a hammer assembly 46 which causes its hammer to project forward when energized so that the selected type located at the printing position is pressed against the sheet of paper 16 on the platen roller 10 with ink ribbon 48 sandwiched between the selected type 44 and the sheet of paper 16 thereby forming an imprint. Also shown in FIG. 2 is a paper guide 50 which is fixedly mounted on the carriage 24 to guide the advancement of the sheet of paper 16.

Figure 3:
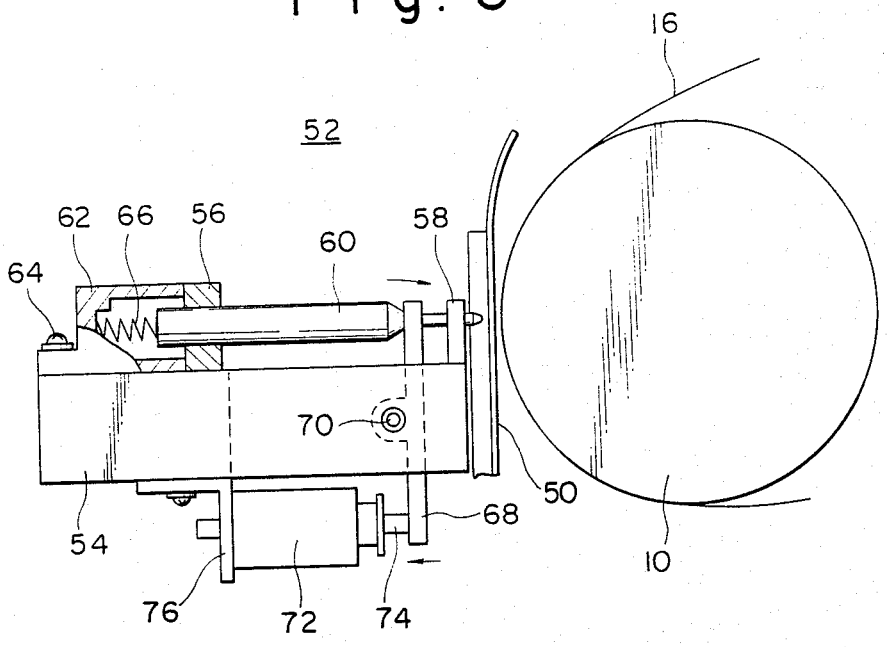
FIGS. 3 and 4 are schematic illustrations showing the structure of the pen print head in the printer of FIG. 1.
Figure 4:
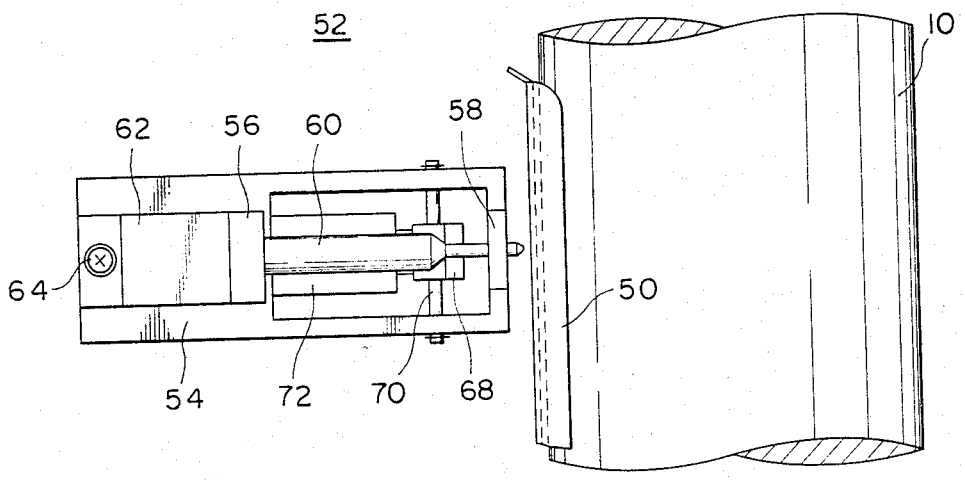

Referring back to FIG. 1, the printer also includes a pen print head 52 arranged side-by-side to the left of the carriage 24. The detailed structure of the pen print head 52 is shown in FIGS. 3 and 4. As shown, the pen print head 52 includes a support block 54 which is fixedly attached to the carriage 24 and which is provided with a pair of rear and front upright projections 56 and 58, each of which is provided with a through-hole. Thus, a ball-point pen 60 may be supported above the support block 54 with its tip end, or ball-pint end, directed toward the center of the platen roller 10 as fitted in the through-holes of these projections 56 and 58. The rear end of the pen 60 is housed in cap 62 which is releasably and tightly attached to the support block 54 by means of a screw 64. Inside of the cap 62 is provided a compression spring 66 which applies a bias force to the pen 60 in the direction toward the platen roller 10.

As best shown in FIG. 4, the support block 54 is partly hollow and a lever 68 is provided as extending through this hollow portion and pivotally supported by a supporting shaft 70 which extends horizontally through this hollow portion. The top end of the lever 68 is formed with a notch in which a forward narrowed section of the pen 60 may be fitted whereby a shoulder of the pen 60 may engage with the top end of the lever 68. On the other hand, the bottom end of the lever 68 is coupled to an actuator rod 74 of a solenoid 72 which is fixedly attached to the support block 54 through a bracket 76. Thus, when the solenoid 72 is energized to have the actuator rod 74 retracted as indicated by the arrow, the lever 68 is caused to pivot clockwise around the shaft 70. As a result, the pen 60 moves forward under the recovery force of the spring 66 so that the ball-point end becomes pressed against the sheet of paper 16 on the platen roller 10 with a predetermined pressure.

As best shown in FIG. 3, the top portion of the paper guide 50 is slightly curved toward the platen roller 10 and its side portions p and q are bent in the direction moving away from the platen roller 10 as shown in FIG. 1. The paper guide 50 is shown in more detail in FIG. 5, and, as shown, it is provided with a pair of mounting projections 78 and 80 which project downwardly from the bottom end of the guide 50. As shown, each of the mounting projections 78 and 80 is provided with a notch which may be used to attach the paper guide 50 fixedly to the carriage 24, for example, by means of screws and the like. As shown in FIGS. 1 and 4, when the paper guide 50 is set in position as fixedly attached to the carriage 24, there is defined a predetermined gap between the paper guide 50 and the platen roller 10. The paper guide 50 helps provide smooth movement of the sheet of paper 16 when the platen roller 10 is driven to rotate, and, thus, the sheet of paper 16 is prevented from interfering with the ink ribbon 48 or other related elements.

Figure 5:
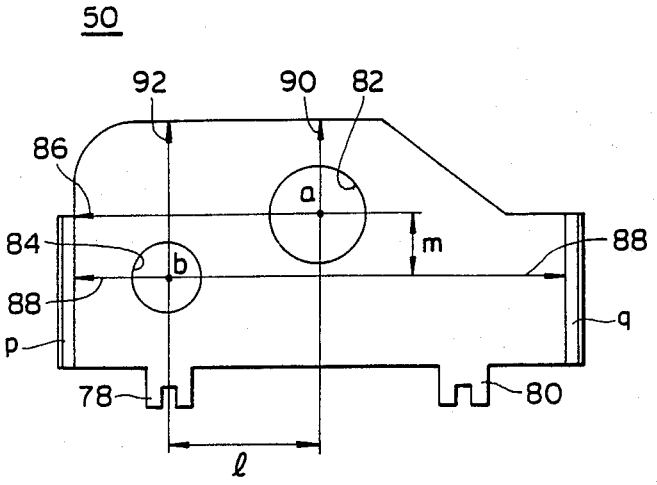
FIG. 5 is a front view showing a paper guide provided in the printer of FIG. 1.

As shown in FIG. 5, the paper guide 50 is provided with a pair of circular printing windows 82 and 84 corresponding in position to the type wheel print head 38 and the pen print head 52, respectively. In the illustrated example, the center of the printing window 82 corresponds to the printing position a of the type wheel print head 38 and the center of the printing window 84 corresponds to the printing position b of the pen print head 52. In the present case, the printing window 82 is located generally at the center of the paper guide 50 and the other printing window 84 is located at a position which is separated by a distance l horizontally to the left and by a distance m vertically downward from the printing window 82. Preferably, the distance l is selected to be an integer multiple of a unit feed amount by the carriage drive motor 34 and the distance m to be an integer multiple of a unit feed amount by the line feed drive motor 22. The paper guide 50 is also provided with marks 86, 88, 90 and 92 on both side and top edges for indicating the horizontal and vertical positions of the printing positions a and b.

Figure 6:
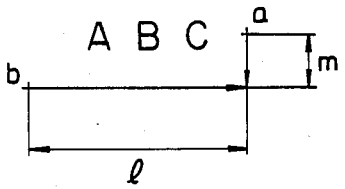
FIG. 6 is a schematic illustration which is useful for explaining the printing mode change sequence in which the pen is to be used following printing by the type wheel in the printer of FIG. 1.

With this structure, graphic and character printing can be carried out by using the type wheel print head 38 and the pen print head 52 selectively while rotating the platen roller 10 and moving the carriage 24 along the platen roller 10. For example, as shown in FIG. 6, if graphic printing by the pen print head 52 is to be carried out after having printed the characters "A B C" by the type wheel print head 38, the carriage 24 is moved automatically to the right by the distance l in response to a signal supplied from a print control system and then the platen roller 10 is driven to rotate in the reverse direction over an angle which corresponds to the vertical distance m thereby bringing the printing position b to a position which is the next printing position after the printed character "C". Then, the solenoid 72 is energized to bring the ball-point end in pressure contact with the sheet of paper 16 around the platen roller 10. Thus, a desired graphic image may be printed by moving the carriage 24 along the platen roller 10 while driving the platen roller 10 to rotate it in either direction.

In the above-described embodiment, the carriage 24 is provided with the type wheel print head 38 and the pen print head 52. It should be noted however that the type wheel print head 38 may be substituted by a print head of another kind such as a thermal print head or an ink jet print head. Moreover, the pen print head may include more than one pen, different in color or other characteristic. Besides, the pen print head 52 may be provided at a different location of the carriage 24, for example at its center or the right side. If desired, the pen print head 52 may be provided on a side of the carriage 24.

Figure 7:
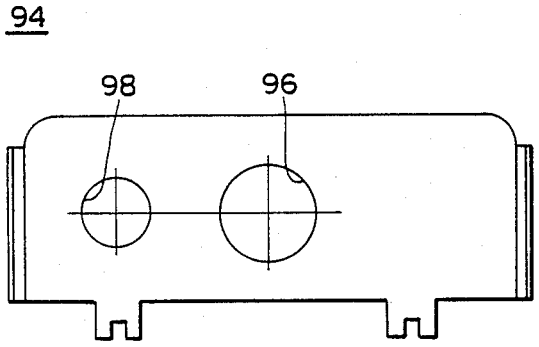
FIGS. 7 through 9 are front views showing several modified paper guides.
Figure 8:
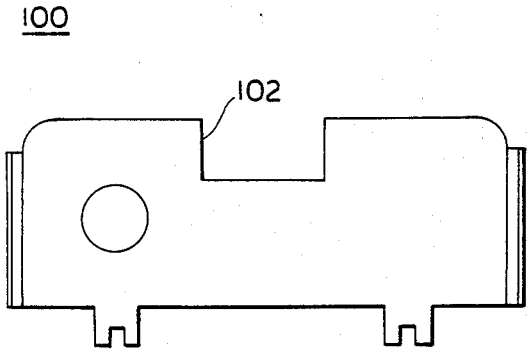
Figure 9:
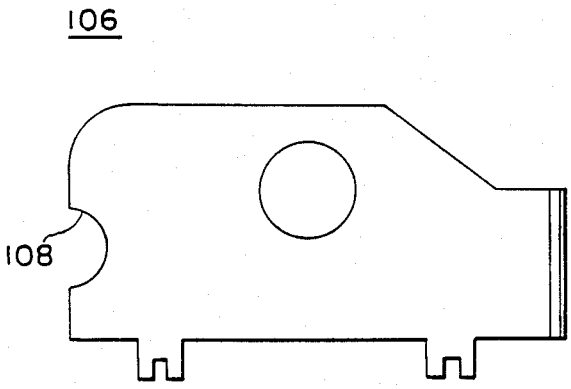

FIG. 7 illustrates a modified paper guide 94 provided with a pair of circular printing windows 96 and 98 which are arranged as spaced apart from each other over the distance l horizontally but aligned at the same height as far as their centers are concerned. It should be understood that the type wheel print head 38 and the pen print head 52 are mounted on the carriage 24 so as to have their printing positions located at the centers of these printing windows 96 and 98. FIG. 8 shows another modified paper guide 100 in which one 102 of the printing windows is formed as a rectangular notch instead of a circular printing window. FIG. 9 shows a further modified paper guide 106 in which one 108 of the printing windows is formed as a circular notch instead of a circular printing window. In FIG. 1 is indicated a ribbon cassette 104 which stores therein the ink ribbon 48 and which is detachably mounted on the carriage 24 in a manner well known for one skilled in the art.

Figure 10:
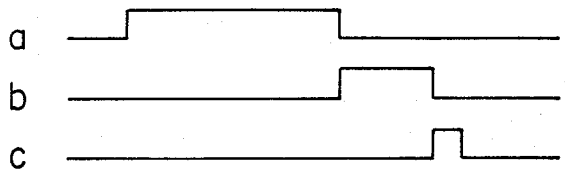
FIG. 10 is a timing chart showing several signals to be used in a character printing mode in which the type wheel is to be used for printing.

In impact printers such as wheel printers using a type wheel, a wait time period is typically provided between the two consecutive printing operations thereby allowing undersired vibration, such as hunting, to die down substantially before carrying out the next printing. Described more in detail in this respect with reference to the timing chart of FIG. 10, when printing is to be carried out using a type wheel, upon completion of a control operation for controlling related elements for printing a selected character by a signal a, the next printing data c is supplied only after the elapsing of a time period determined by a wait signal b. The time period of wait signal b is determined such that it is long enough for the undesired vibration, such as hunting, to die down substantially prior to the initiation of the next printing operation, to thereby maintain the quality of printed characters.

Figure 11:
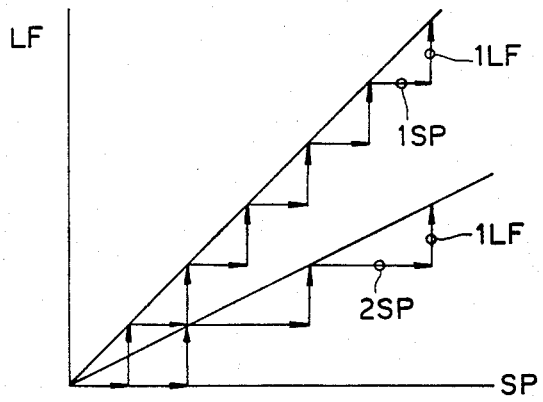
FIG. 11 i a graph schematically showing how lines are drawn by the pen in a graphic printing mode.

On the other hand, in non-impact printers such as pen recorders using ball-point pens, the pen is normally kept in contact with a sheet of paper during printing operation so that hunting is not a problem and thus there is no need to provide a wait time period as different from the wheel printer. Thus, in the case of a hybrid printer which is a combination of the impact printer with the non-impact printer as in the embodiment illustrated in FIG. 1, it is desirable to include a print control system which provides wait time when the printer operates as an impact printer and which provides no wait time when the printer operates as a non-impact printer. Otherwise, there will be created an undue delay when the hybrid printer operates as a non-impact printer. Explained in this respect more in detail with reference to FIG. 11, when a straight line is to be drawn at 45° by the pen print head of the hybrid printer, one space feed operation (1SP) and one line feed operation (1LF) are carried out alternately so that the pen, in fact, moves stepwise to approximate the straight line. On the other hand, if a straight line is to be drawn at 22.5°, two space feed operations (2SP) and one line feed operation (1LF) are alternately carried out. In such a case, if the print control system for controlling the operation of a type wheel is to be directly used for drawing these straight lines, a busy signal is generated for each of the space and line feed operations to provide wait time thereby slowing down the printing speed.

Figure 12:
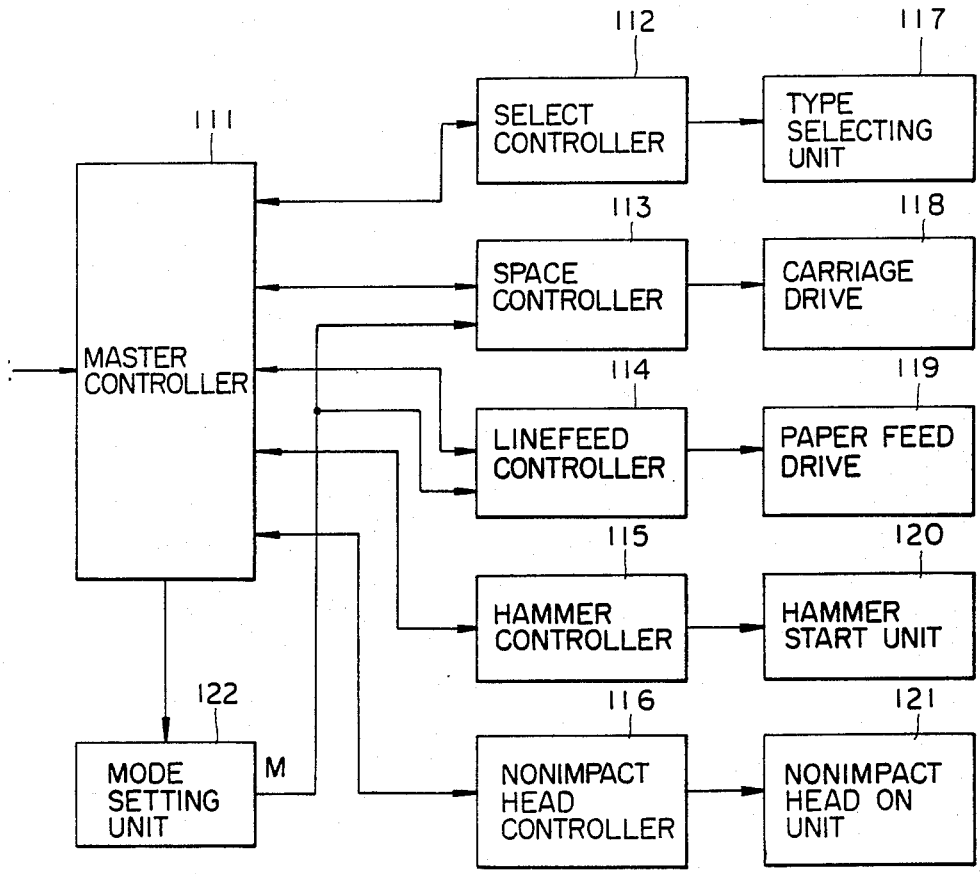
FIG. 12 is a block diagram showing a print control system which can be advantageously applied to the printer of FIG. 1.

FIG. 12 is a block diagram showing the overall structure of a print control system which is constructed in accordance with one embodiment of the present invention and which may be advantageously applied to the hybrid printer of FIG. 1. As shown, the print control system includes a master controller 111 which receives a data signal I as supplied from an external circuit and, after examining the data signal I thus received, supplies signals to a select controller 112, space controller 113, line feed controller 114, hammer controller 115 and non-impact head controller 116, which are connected to a type selecting unit 117, carriage drive 118, paper feed drive 119, hammer start unit 120 and non-impact head on unit 121, respectively. For example, if the print control system of FIG. 12 is applied to the hybrid printer of FIG. 1, the type selecting unit 117 may include the selection motor 42 for rotating the type wheel 40 to locate a selected type 44 at its printing position. The carriage drive 118 may include the carriage drive motor 34 for driving the carriage 24 to move it along the platen roller 10. The paper feed drive 119 may include the line feed motor 22 for driving the platen roller 10 to rotate it. The hammer start unit 120 may include the impact hammer assembly 46. And, the non-impact head on unit 121 may include the pen print head 52.

Each of the controllers 112 through 116 supplies a busy signal, indicating whether or not it can receive the next data, to the master controller 111. If each of the busy signals is "0", then the master controller 111 can supply the next data to each of the controllers 112 through 116; on the other hand, if the busy signal is "1", then the master controller 111 temporarily reserves the next data. Furthermore, under the control of the master controller 111, the mode setting unit 122 supplies a mode signal M, which is "1" if the non-impact printing mode is designated and "0" otherwise, to the space and line feed controllers 113 and 114. It is to be noted that printing mode change takes place in accordance with the contents of the data signal I supplied from the external circuitry.

Figure 13:
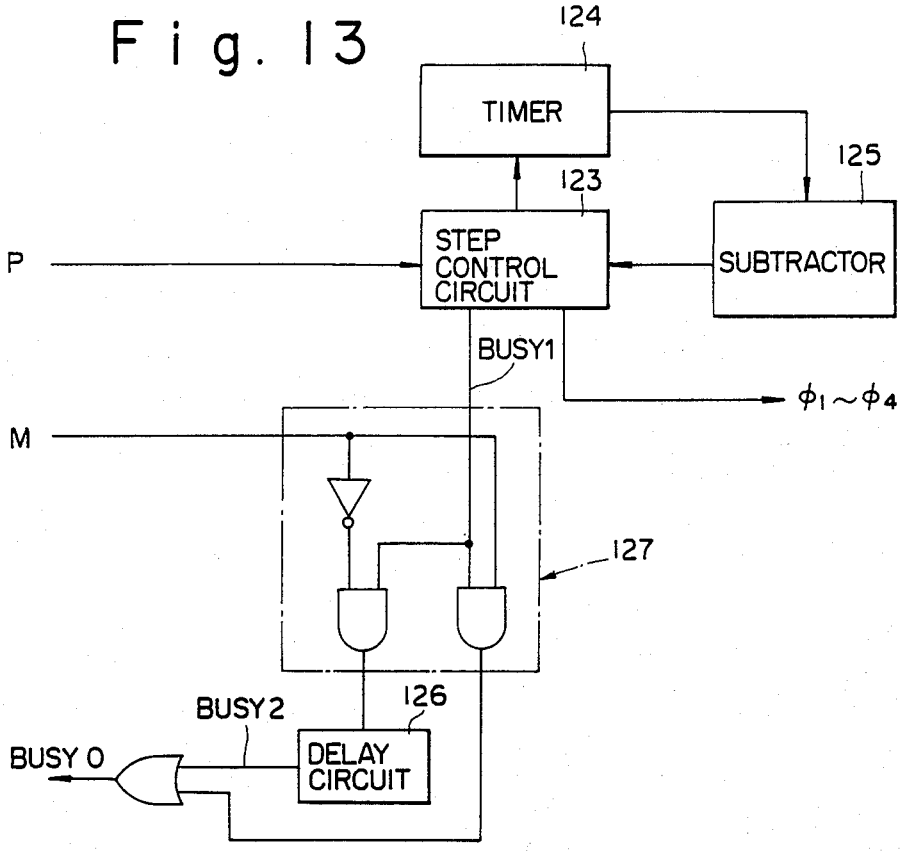
FIG. 13 is a block diagram showing in detail the structure of the space controller 113 in FIG. 12.

FIG. 13 is a block diagram showing the structure of one example of the space controller 113 in the system of FIG. 12. Typically, use is made of a step motor for the carriage drive 118, and the amount of space feed designated by the data signal I supplied from the external circuitry is converted by the master controller 111 into the number of pulses P to be supplied to such a step motor. This data P is supplied to the space controller 113 where step pulse signals $\phi_1$ through $\phi_4$ having predetermined pulse widths and phase differences are formed. At the space controller 113, there is also formed a space busy signal BUSY0 which tells the end of space control operation to the master controller 111.

Figure 14:
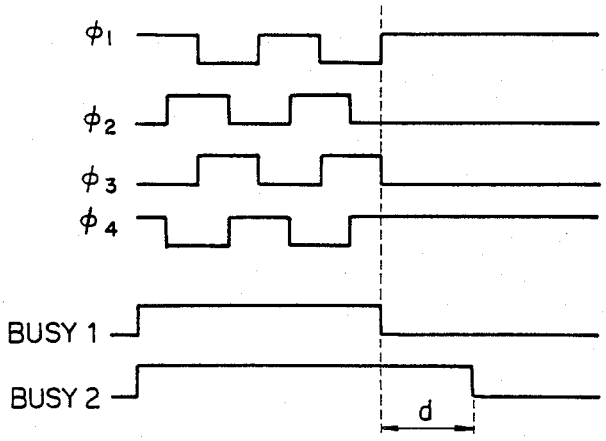
FIG. 14 is a timing chart which is useful for explaining the operation of the structure shown in FIG. 13.

As shown in FIG. 13, the illustrated space controller 113 includes a step control circuit 123 which generates a step pulse signal in accordance with the data P from the master controller 111, a timer 124 for determining the pulse width of a step pulse, a subtractor 125 for carrying out count down of the number of step pulses, a delay circuit 126 for delaying a space execution signal BUSY1 outputted from the step control circuit 123 even after the end of space control operation, and a switching circuit 127 for outputting a space busy signal BUSY0 by carrying out switching between the space execution signal BUSY1 and a delay signal BUSY2 from the delay circuit 126 in accordance with the mode signal M from the mode setting unit 122. FIG. 14 shows the timing chart for the step pulse signals $\phi_1$ through $\phi_4$, space execution signal BUSY1 and delay signal BUSY2 for delaying the termination of the space execution signal. Of importance, the space execution signal BUSY1 turns to "0" simultaneously with the termination of the step pulse signals $\phi_1$ through $\phi_4$; however, the delay signal BUSY2 remains Hi or "1" for a time period of d thereafter.

The operation of the space controller 113 illustrated in FIG. 13 will now be described. In the first place, the data P from the master controller 111 is set into a counter (not shown) provided in the step control circuit 123. When the data is so set, the step control circuit 123 initializes the step pulse signals $\phi_1$ through $\phi_4$, which are then supplied to the carriage drive 118, and at the same time starts the timer 124 to produce a pulse having a predetermined pulse width. When the timer 124 times up, the subtractor 125 causes the count of the counter inside the step control circuit 123 to be decremented by "1" and then the timer 124 is restarted by the step control circuit 123. In this manner, the operation is carried out one step at a time, and this is repeated until the count of the counter inside the step control circuit 123 reaches "0". When the count has reached "0", the supply of step pulses $\phi_1$ through $\phi_4$ is terminated.

The space execution signal BUSY1 outputted from the step control circuit 123 turns to Hi or "1" upon initiation of supply of step pulses $\phi_1$ through $\phi_4$ and turns to Lo or "0" upon termination of supply thereof. In the case where the mode signal M is "1" and the non-impact printing mode is designated, the switching circuit 127 outputs the space execution signal BUSY1 as the space busy signal BUSY0, so that it is possible for the master controller 111 to supply the next print data immediately after the termination of supply of the step pulses. On the other hand, in the case where the mode signal M is "0" and the printing mode is other than the non-impact printing mode, the switching circuit 127 outputs the delay signal BUSY2 as the space busy signal BUSY0, and, therefore, the master controller 111 can supply the next print data only after the elapse of the delay time period d upon termination of the supply of the step pulses.

Although the above-described embodiment has been described as to the case when the structure shown in FIG. 13 has been applied to the space controller 113, it is to be noted that the structure of FIG. 13 can be equally applied to the line feed controller 114. And, thus, when both of the space and line feed controllers 113 and 114 are so structured, no wait time is provided for space and line feed operations during the non-impact printing mode, thereby allowing an increase in printing speed.

Figure 15:
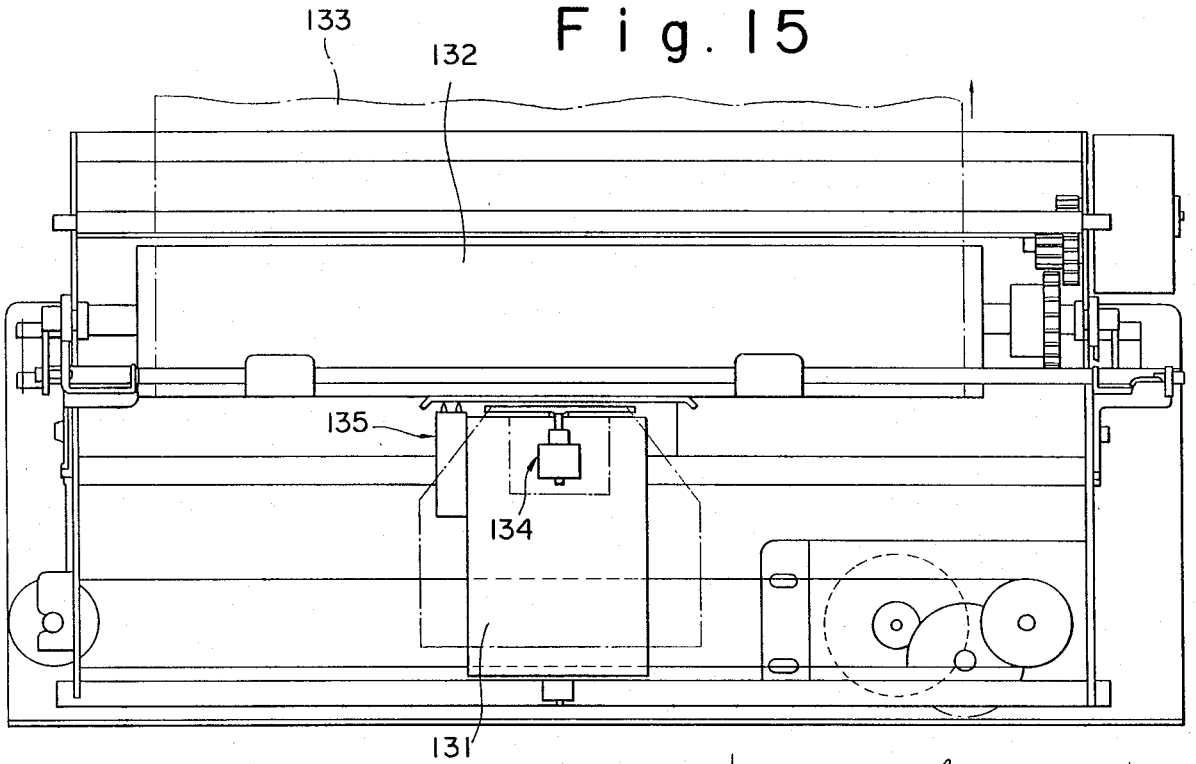
FIG. 15 is a plan view showing a hybrid printer provided with a type wheel print head and a multi-pen print head constructed in accordance with another embodiment of the present invention.

FIG. 15 illustrates another embodiment of the present invention in which are provided a type wheel print head 134 and a pen print head 135 including four pens. This hybrid printer is structurally similar in many respects to the hybrid printer of FIG. 1 and it includes a rotatably supported platen roller 132, around which a sheet of paper 133 is placed, and a carriage 131 which is provided to be reciprocatingly movable along the platen roller 132. The hybrid printer of FIG. 15 is also provided with space drive and line feed drive motors which can be driven to rotate in either direction similarly with the hybrid printer of FIG. 1. On the carriage 131 is mounted the type wheel print head 134 and the ball-point pen print head 135 which includes four ball-point pens **135*b* through 135*e* which in turn are all different in color and selectively used one at a time. As described with reference to the hybrid printer of FIG. 1, the type wheel print head 134 of the hybrid printer shown in FIG. 15 is also mounted at one side of the carriage 131 and its type wheel is rotated by the selection motor to locate a selected type at a predetermined printing position, which is then pressed against the sheet of paper 133 on the platen roller 132 with ink ribbon sandwiched between the selected type and the sheet of paper 133 by the impact of the printing hammer. In the hybrid printer illustrated in FIG. 15, the pen print head 135 is mounted on the carriage 131 at the left-hand side thereof, though it may also be disposed at the right-hand side, and it includes four ball-point pens 135*b* through 135*e*, all different in color, with their ball-point ends directed toward the platen roller 132**. It is so structured that these four pens may be used selectively one at a time using an electromagnetic solenoid.

Figure 16:
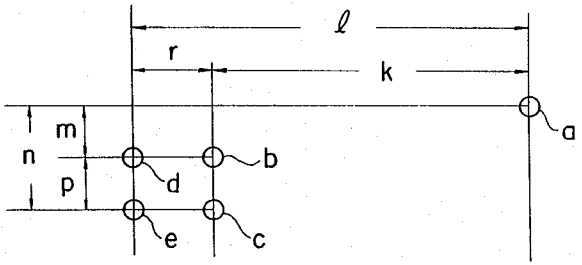
FIG. 16 is a schematic illustration showing the arrangement of the printing devices provided in the printer shown in FIG. 15.

FIG. 16 illustrates the arrangement of or positional relation between the printing position a of the type wheel print head 134 and the respective printing positions (ball-point ends) b, c, d and e of the four ball-point pens **135*b* through 135*e*. In the case where, after having printed characters "A B C" using the type wheel print head 134 through the printing position a, if it is desired to draw a line using the pen print head 135*b* through the printing position b, adjustment in printing position must be carried out such that the carriage 131 is moved to the right by a distance k and the platen roller 132 is rotated in the reverse direction over an angle corresponding to a distance m thereby bringing the ball-point end of pen 135*b* or the printing position b to the next printing position on the sheet of paper 133 after the character "C" printed by the type wheel print head 134**.

Figure 17:
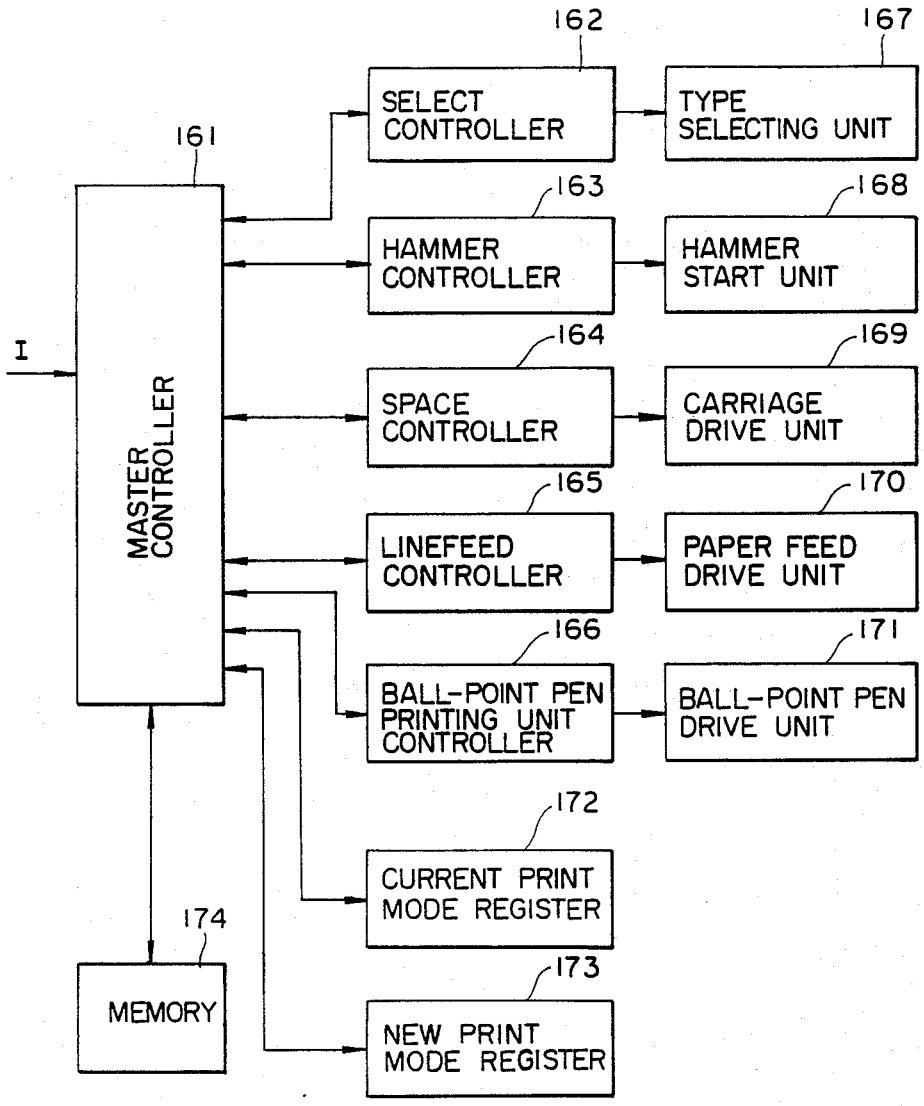
FIG. 17 is a block diagram showing a print control system provided in the printer shown in FIG. 15.

FIG. 17 is a block diagram showing a print control system which may be advantageously applied to the hybrid printer shown in FIG. 15. The overall structure of this print control system is similar to that shown in FIG. 12. As shown, the print control system of FIG. 17 includes a master controller 161, which receives a data signal I supplied from external circuitry and, after examining the thus supplied data signal I, supplies signals to a select controller 162, hammer controller 163, space controller 164, line feed controller 165, and ball-point pen printing unit controller 166. In accordance with the signals supplied from the master controller 161, the controllers 162 through 166 control the operation of a type selecting unit 167, hammer start unit 168, carriage drive unit 169, paper feed drive unit 170 and ball-point pen drive unit 171, respectively. Of importance, the system of FIG. 17 includes a current print mode register 171 and a new print mode register 173 as connected to the master controller 161. Also provided is a memory 174 which is also connected to the master controller 161. Thus, according to the master controller 161, the print mode selected by the data signal I from the external circuitry is stored in the current print mode register 172 and the next or newly designated print mode is stored into the new print mode register 173. The memory 174 stores the data as to the relative positional relation among the printing positions a through e shown in FIG. 16, which may be referred to and used by the master controller 161. Preferably, the memory is comprised of a non-volatile memory, such as a read only memory. The following TABLE I shows an example of a table containing the data as to the relative positional relation between the five printing positions shown in FIG. 16 stored in the memory 174.

TABLE I

| Current Mode | New Mode | Memory Address | SP Data | Memory Address | LF Data |
|---|---|---|---|---|---|
| | a | 0 | 0 | 1 | 0 |
| a | b | 2 | k | 3 | −m |
| wheel | c | 4 | k | 5 | −n |
| 134 | d | 6 | 1 | 7 | −m |
| | e | 8 | 1 | 9 | −n |
| | a | 10 | −k | 11 | m |
| b | b | 12 | 0 | 13 | 0 |
| pen | c | 14 | 0 | 15 | −p |
| 135b | d | 16 | r | 17 | 0 |
| | e | 18 | r | 19 | −p |
| | a | 20 | −k | 21 | n |
| c | b | 22 | 0 | 23 | −p |
| pen | c | 24 | 0 | 25 | 0 |
| 135c | d | 26 | r | 27 | −p |
| | e | 28 | r | 29 | 0 |
| | a | 30 | −1 | 31 | −m |
| d | b | 32 | −r | 33 | 0 |
| pen | c | 34 | −r | 35 | p |
| 135d | d | 36 | 0 | 37 | 0 |
| | e | 38 | 0 | 39 | p |
| | a | 40 | −1 | 41 | n |
| e | b | 42 | −r | 43 | p |
| pen | c | 44 | −r | 45 | 0 |
| 135e | d | 46 | 0 | 47 | p |
| | e | 48 | 0 | 49 | 0 |

In the above TABLE, the print modes a through e indicate to carry out printing selectively using the printing means having the printing positions a through e as shown in FIG. 16. SP data indicates the amount of space feed and LF data indicates the amount of line feed. The minus sign in the SP and LF data indicates the feed in the reverse direction.

Figure 18:
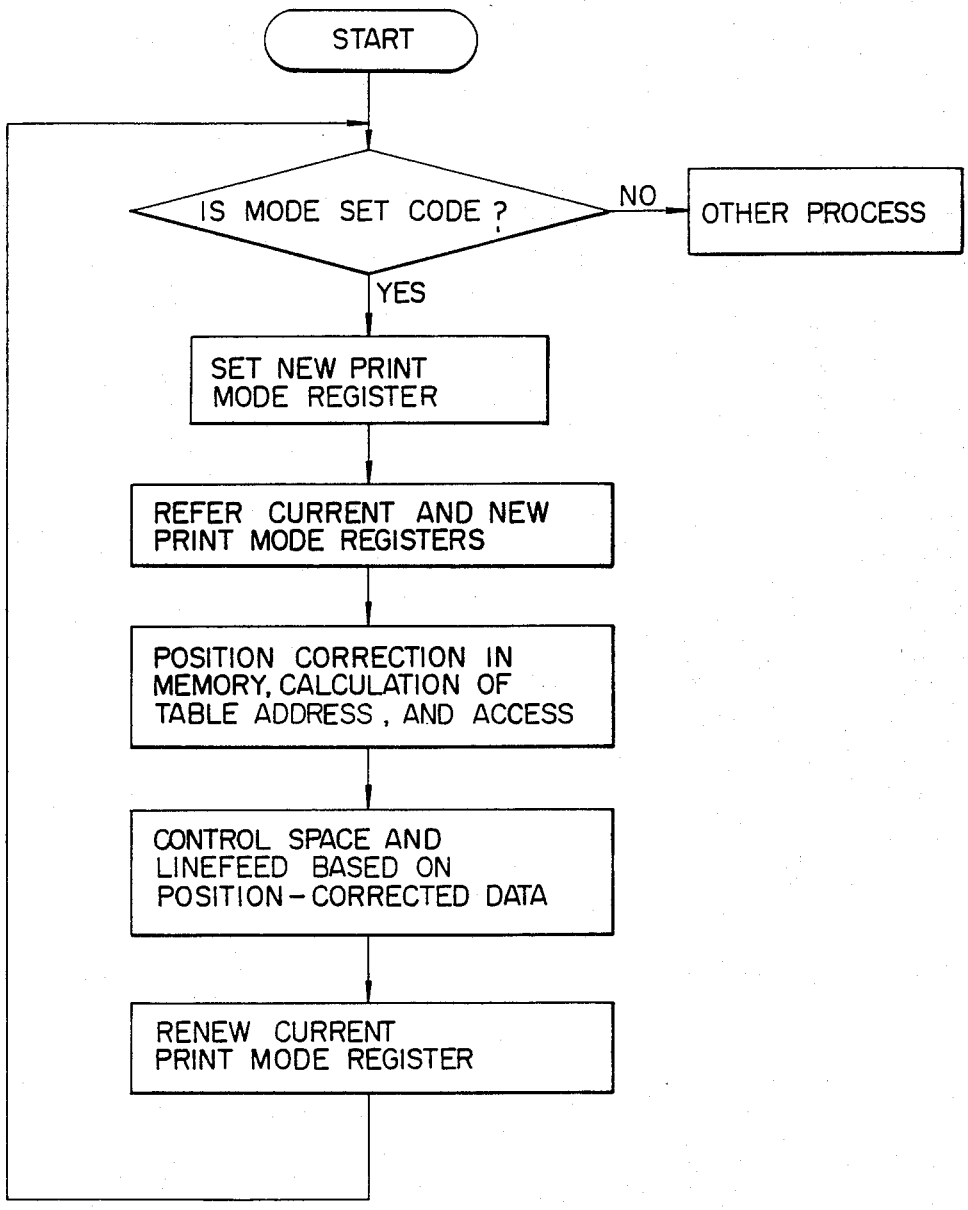
FIG. 18 is a flow chart showing the steps in the printing mode changing sequence carried out by the print control system of FIG. 17.

Now, the operation of changing the head or printing positions according to the change of print modes will be described with reference to FIGS. 17 and 18. Upon receipt of the data signal I, the master controller 161 determines as to whether it includes a print mode setting code. If negative, then it proceeds to other process steps; on the other hand, if affirmative, its contents are stored into the new print mode register 173. Then, at the master controller 161, from the contents now stored in the current print mode register 172 and in the new print mode register 173, an address to be accessed in the memory 174 is calculated, thereby obtaining head position or print position correction data including SP and LF data (see TABLE I). These head position correction data obtained by accessing the memory 174 are then transferred through the master controller 161 to the space and line feed controllers 164 and 165, respectively, which thus drive the respective carriage drive unit 169 and the paper feed drive unit 170 thereby allowing to change the head position on the basis of the correction data.

Figure 19:
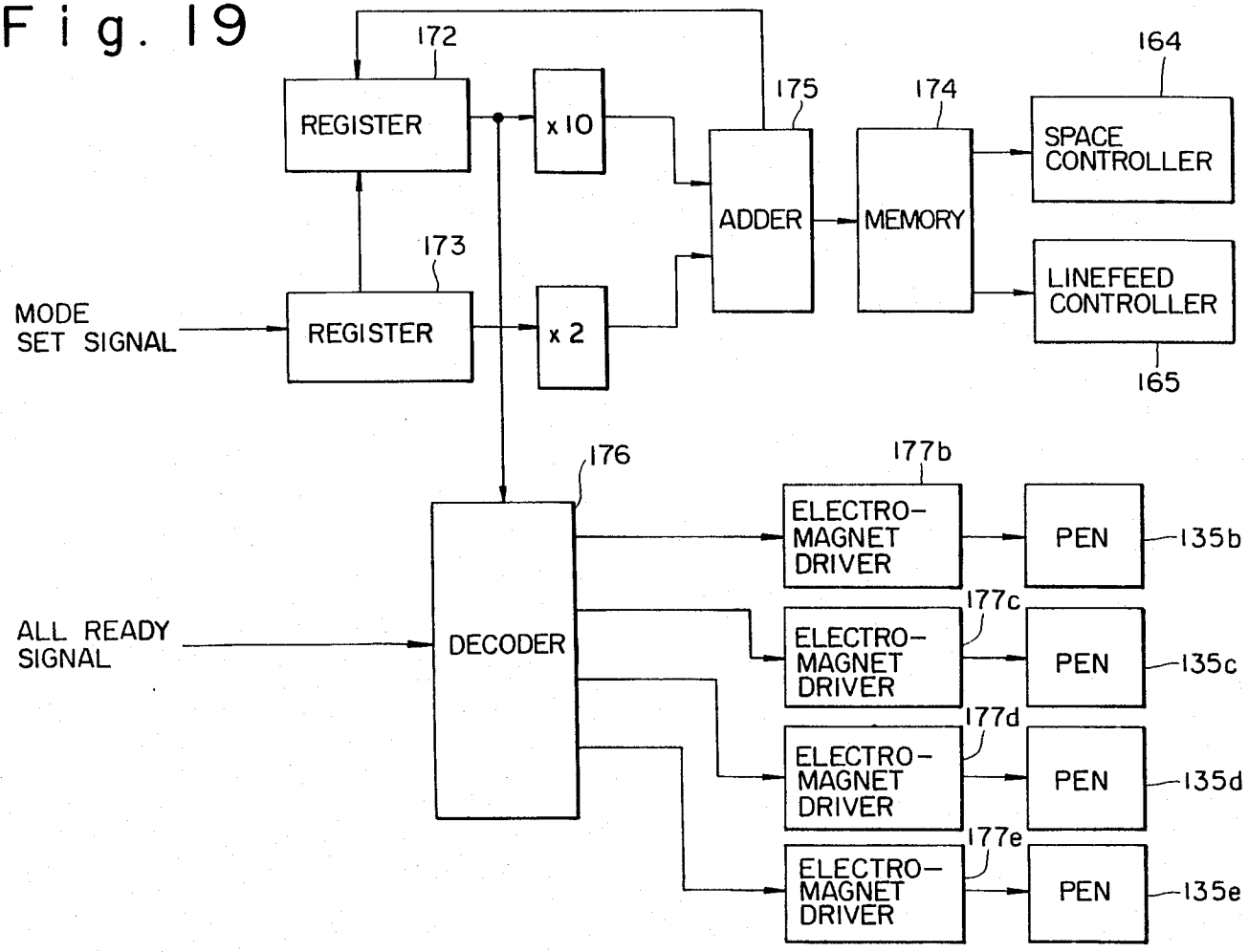
FIG. 19 is a block diagram showing a more detailed structure of part of the system shown in FIG. 17.

One example of calculating the memory address mentioned above will be described with reference to FIG. 19. That is, upon completion of operation of each of the controllers 162 through 166, the master controller 161 operates to have a code of newly designated print mode stored into the register 173. Here, it is assumed that the print mode using the print or head position a of type wheel print head is designated by a code "0", and the print modes using one of the print or head positions b, c, d and e of multi-color pen print head are designated by "1", "2", "3" and "4", respectively. The register 172 stores the data of currently selected print mode. The data in the register 172 is multiplied by two and supplied to an adder 175 which receives another input data which is formed by multiplying by ten the data in the register 142. The data thus added at the adder 175 is then used as an address to access the ROM 174.

For example, in the case where the currently selected print mode is a character print mode using the head position a of type wheel print head and the newly designated print mode is a graphic print mode using the head position e of pen print head, the data in the register 172 is "0" and the data in the register 173 is "4". And thus the resulting data at the adder 175 is "8", which constitutes a front address in the memory 174 storing SP and LF data required to change the printing position from the head position a of type wheel print head to the head position e of pen print head. Thus, in order to move the head position e of pen print head to the current position of head position a of type wheel print head, the address 8 in the memory is accessed to transfer the SP data 1 to the space controller 164 and the LF data -n to the line feed controller 165. As a result, the carriage 131 is moved along the platen roller 132 in the forward direction by the amount of 1 pitches and the sheet of paper 133 is moved in the reverse direction by the amount of n pitches. When the adder 175 supplies an addition end signal to the register 172, the data in the register 172 is transferred to and thus overwritten into the register 172. Then, when an ALL READY signal, which indicates the end of operation of the space and line feed controllers 164 and 165, is supplied to a decoder 176, the decoder 176 supplies an actuation signal to one of electromagnet drivers **177*b* through 177*e* selectively in accordance with the contents of the register 172 thereby carrying out a pen down operation to cause a selected one of the pens 135*b* through 135*e* to be pressed against the sheet of paper 133**.

Figure 20:
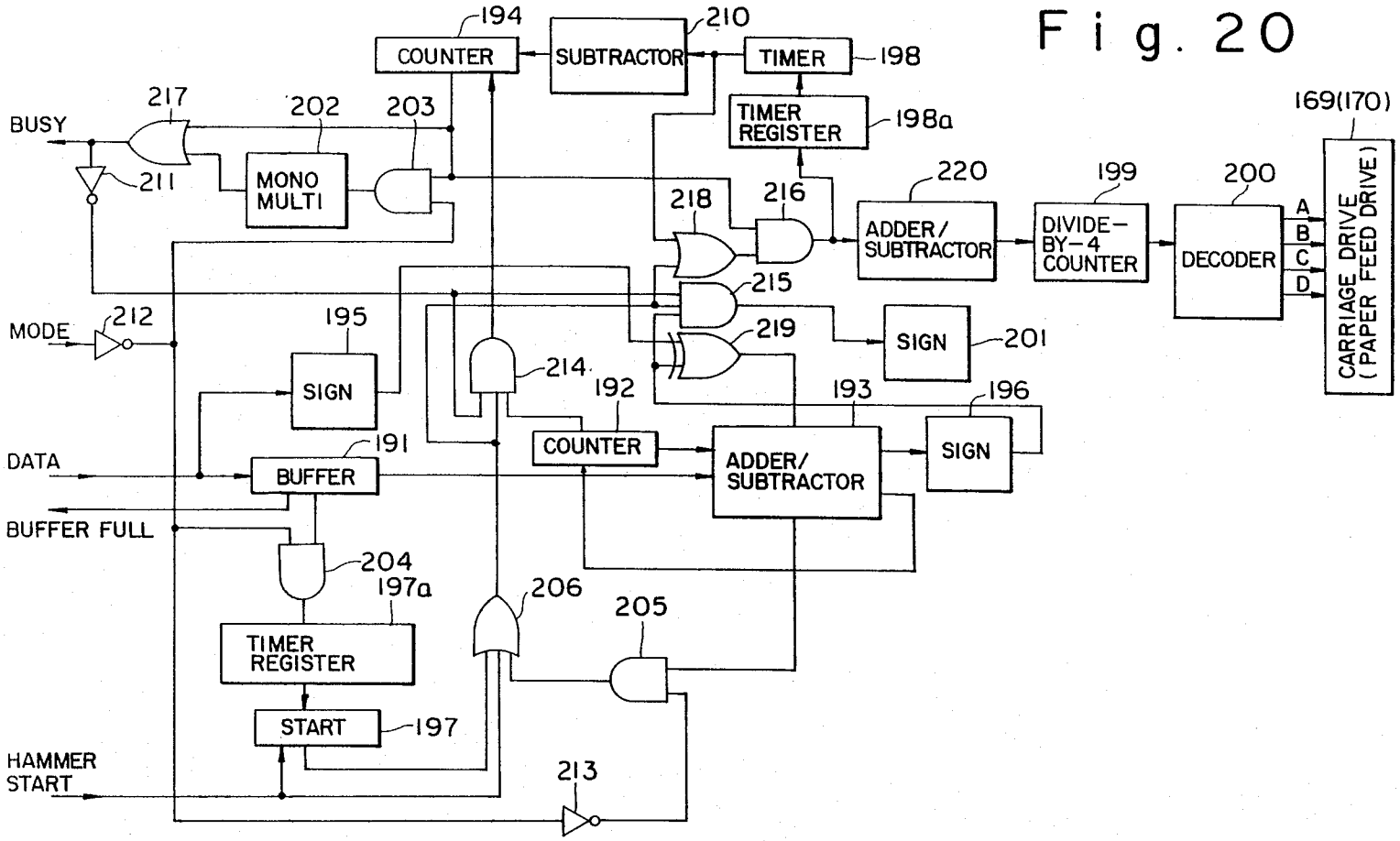
FIG. 20 is a block diagram showing a data optimization circuit which can be advantageously applied to the space and line feed controllers in the system of FIG. 17.

When changing the print head position currently located at a predetermined printing position to another print head position, it is preferable to carry out data optimization control by processing the current and next print data so as to carry out the change of print head positions more efficiently by moving the carriage 131 and/or rotating the platen roller 132. FIG. 20 is a block diagram showing an example of the structure of space controller 164 (or line feed controller 165) capable of carrying out such data optimization control in the print head position changing operation. It is to be noted that although the following description as to such data optimization control will be focused on the space controller 164, it is equally applicable to the line feed controller 165. It is also to be noted that "data optimization control" indicates that a series of two or more data are temporarily stored in a buffer to carry out appropriate processing between the data to obtain new data which allow the selected head position to move to a predetermined printing position through a shortest moving distance thereby minimizing the time required for the intended head position correction.

The space controller 164 when so structured as illustrated in FIG. 20 includes a buffer 191 for temporarily storing data DATA transferred from the master controller 161, an adder/subtractor 193 for carrying out calculations between data, a counter 192 for storing the calculated data, a counter 194 for storing the calculated data and supplying the calculated data as a final output to the carriage drive unit 169, a timer 197 for setting wait time for the next data so as to carry out data optimization control, a timer 198 for determining the pulse width of a pulse to be applied to a step motor in the carriage drive unit 169, a combination of a divide-by-4 counter 199 and a decoder 200 for controlling the phases of four signals A, B, C and D to be supplied to the step motor and sign units 195, 196 and 201. In the following description, the space data transferred from the master controller 161 to the space controller 164 in order to carry out position correction due to the change of print heads will be designated by SP1, and the space data transferred from the master controller 161 to the space controller 164 following SP1 in order to move the head position of the changed print head to a position on the sheet of paper 132 where the next printing is to be initiated after the change of print heads will be designated by SP2. If a BUFFER FULL signal is "0", the data SP1 from the master controller 161 is stored into the buffer 191, and, at the same time, the sign unit 195 is reset if the data SP1 is in the forward direction or set if it is in the reverse direction. On the other hand, if the BUFFER FULL signal is "1", the timer 197 is refreshed and it is waited until the BUFFER FULL signal becomes "0". Then the data SP1 in the buffer 191 is added to or subtracted from the data in the counter 192 at the adder/subtractor 193, in which whether it is addition or subtraction is determined by an exclusive OR between outputs from the sign unit 195 and from the sign unit 196 which indicate the direction of the data in the counter 192. That is, if the data in the sign units 195 and 196 are identical, addition is carried out; otherwise, subtraction is carried out.

In the counter 192, there is stored the SP data which has been previously transferred and held in a stand-by condition due to the wait time of timer 197, or its contents are all 0s if all of the previous SP data have already been executed. The result of addition or subtraction at the adder/subtractor 193 is again stored into the counter 192, whereby if BORROW becomes "1" during subtraction, the sign of the sign unit 196 is inverted. Therefore, the resulting direction and amount of movement after calculations will become as tabulated in the following TABLE II depending upon the contents of counter 192 and buffer 191. It is to be noted that, in the following TABLE II, SP indicates spacing in the forward direction and BSP spacing in the reverse direction.

TABLE II

| Counter 62 | Buffer 61 | Adder/Sub. 63 | Sign 66 | Direction | Amount |
|---|---|---|---|---|---|
| SP 100 | SP 50 | Addition | + | SP | 150 |
| BSP 100 | BSP 50 | Addition | − | BSP | 150 |
| SP 100 | BSP 150 | Subtraction | − | BSP | 50 |
| SP 200 | BSP 50 | Subtraction | + | SP | 150 |
| SP 100 | BSP 100 | Subtraction | + | | 0 |
| BSP 100 | SP 50 | Subtraction | − | BSP | 150 |
| BSP 150 | SP 200 | Subtraction | − | BSP | 50 |

Thereafter, when the new space data SP2 is transferred from the master controller 161, the space controller 164 carries out the similar operation as in the case for the data SP1 so that calculation is carried out using the data in the counter 192 and the buffer 191. Then, when the timer 197 times up, the contents of the counter 192 are transferred to the counter 194 thereby clearing the counter 192 and having the sign in the sign unit 196 stored into the sign unit 201. It is to be noted that the time period set in the timer 197 typically ranges between 10 and 100 milliseconds. Thus, in the counter 194 is stored an optimized data obtained by processing the position correction data SP1 and the new space data SP2 with the sign unit 201 storing the information as to the direction of the data in the counter 194. Besides, the BUSY signal indicating the progress of space feed operation is set "1".

Simultaneously with storing of the thus obtained data into the counter 194, a unit operation time period for the step motor in the carriage drive unit 169 is set in the timer 198. Then, in accordance with a time-up signal from the timer 198, the divide-by-4 counter 199 initiates either count-up or count-down operation depending upon the contents of the sign unit 201. That is, if the sign unit 201 contains "0", then the divide-by-4 counter 199 carries out a count-up operation thereby controlling the carriage drive unit 169 by sequentially supplying 4-phase step pulses A, B, C and D through the decoder 200 to move the carriage 131 in the forward direction, or to the right in FIG. 15. On the other hand, if the sign unit 201 contains "1", the divide-by-4 counter 199 carries out a count-down operation through the adder/-subtractor 220 thereby causing the carriage 131 to move in the reverse direction, or to the left in FIG. 15. In response to a time-up signal from the timer 198, the counter 194 subtracts its count by "1" each time through the subtractor 210 and the timer 198 is refreshed until the count of counter 194 reaches "0". When the count of counter 194 reaches zero, the supply of the pulses A, B, C and D is terminated and at the same time the mono-multi 202 is triggered to produce a pulse signal of predetermined length thereby maintaining the BUSY signal to be "1" for a predetermined time period, for example, which is enough for the vibration of carriage drive unit 169 to die down substantially. After moving the head position of a selected print head to a desired position on the sheet of paper 133 where the next printing is to be initiated according to the data optimization control as described above not only for space feed control but also for line feed control, the next printing operation is carried out upon termination of each of the BUSY signals.

Figure 21:
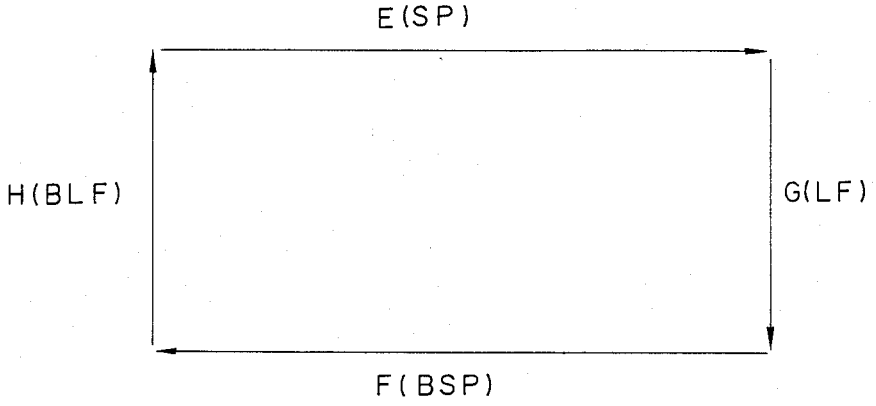
FIG. 21 is a schematic illustration showing as an example how lines are drawn by the pen print head of the printer shown in FIG. 15.

On the other hand, during a graphic print mode using one of the ball-point pens 135*b* through 135*e*, the mode signal in the structure of FIG. 20 becomes "1" so that triggering of mono-multivibrator 202 which extends the period of BUSY signal is inhibited by a gate 203. This is because, since printing by a ball-point pen is of the so-called non-impact type and thus the pen is always kept in contact with the sheet of paper 133 during printing, there is no need to provide wait time for the print head to become stabilized. Furthermore, if the mode signal is "1", a gate 204 forbids the timer 197 from operating and a gate 205 causes the contents of counter 192 to be transferred to the counter 194 immediately after the completion of execution at the adder/subtractor 193. Accordingly, since the count of counter 192 is cleared each time, the data of buffer 191 is always stored into the counter 194. Put it another way, when drawing a graphic pattern shown in FIG. 21 in a pen print mode following the direction indicated by the arrows, the above-described structure allows to prevent the carriage 131 from becoming motionless due to the application of data optimization control operation to the SP data for line E in the forward direction and the SP data for line F in the reverse direction. The similar arguments hold true for line feed control operation involving the LF data for line G and the LF data for line H pointed in opposite directions.

Furthermore, in the structure of FIG. 20, when the HAMMER START signal for starting the impact motion of the hammer in the type wheel print head 134 becomes "1", the timer 197 is reset and at the same time the contents of counter 192 are transferred to the counter 194 by a gate 206. In FIG. 20 are also shown registers 197*a* and 198*a* for storing predetermined timer values to be set at the timers 197 and 198, respectively, inverters 211, 212 and 213, AND gates 217 and 218, OR gate 219 and exclusive OR gate 219.

Figure 22:
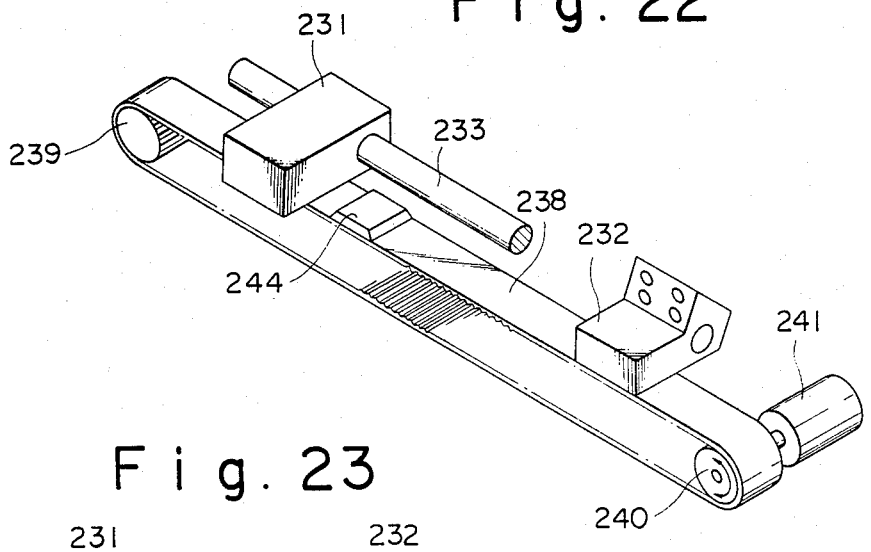
FIGS. 22 and 23 are schematic illustrations showing a further embodiment of the present invention in which two print heads are mounted on separate carriers.
Figure 23:
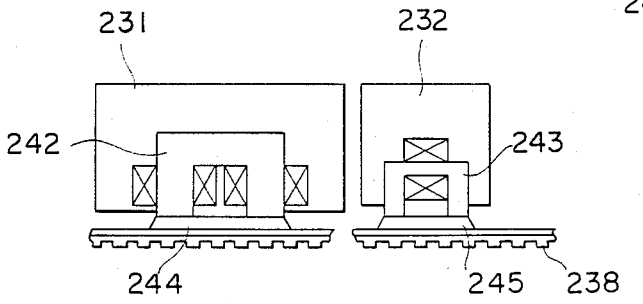

FIGS. 22 and 23 illustrate another embodiment of the present invention in which two carriages each provided with its own print head, are provided as movable separately and selectively along the platen roller in a reciprocating manner. As schematically shown in perspective in FIG. 22, this hybrid printer includes a pair of carriages 231 and 232 which are separately and slidably movably supported on a guide shaft which extends in parallel with a platen roller (not shown). Although not shown specifically, on the carriage 231 is fixedly mounted a selection motor for rotatably supporting a type wheel and an impact hammer assembly for applying an impact force to a selected type of the type wheel. In addition, as described with respect to the previous embodiments, an ink ribbon cassette storing therein ink ribbon is detachably mounted on the carriage 231. On the other hand, on the other carriage 232 is mounted a pen print head including four ball-point pens different in color. Although not shown specifically, it is to be noted that there are defined home positions on both extreme ends of the guide shaft 233 for the carriages 231 and 232, and the carriages 231 and 232 are normally located at the respective home positions when not in use. Preferably, a latch mechanism well known for one skilled in the art is provided in each of these home positions so that the corresponding carriage may be securely held at its home position when not in use.

Below the guide shaft 233 is provided an endless driving belt 238 as extended between a pair of pulleys 239 and 240 and in parallel with the guide shaft 233. The pulley 240 is coupled to a servo motor 241 which may be driven to rotate in either direction. And thus the driving belt 238 may be driven to travel either clockwise or counterclockwise depending upon the rotating direction of the servo motor 241. On the driving belt 238 is fixedly attached a pair of magnetic elements 244 and 245 (only element 244 is shown in FIG. 22). On the other hand, as shown in FIG. 23, the carriages 231 and 232 are provided with electromagnets 242 and 243, respectively. Thus, when the carriage 231 is to be selected for use, a selection signal is supplied to the carriage 231 to have the electromagnet 242 energized so that the magnetic element 244 fixedly attached to the driving belt 238 is magnetically attracted to the electromagnet 242 to establish the coupling between the carriage 231 and the belt 238. And thus the carriage 231 can be moved to the left and the right slidingly along the guide shaft 233 as the belt 238 is driven to travel clockwise or counterclockwise. Similarly, the coupling and decoupling between the carriage 232 and the belt 238 can be easily carried out by energizing and deenergizing the electromagnet 243.

In the preferred embodiment, a recess is formed in the bottom surface of each of the electromagnets 242 and 243 while making the magnetic elements 244 and 245 smaller in size and thus may be fitted into the corresponding recesses. With such a structure, no slippage will occur and a secure coupling can be established between the electromagnet 242 or 243 and the corresponding magnetic element 244 or 245.

In the above-described embodiment, two magnetic elements 244 and 245 are provided on the belt 238; however, there may be provided more than two magnetic elements or only one. Furthermore, there may be provided more than two carriages as slidable along the guide shaft 233. In such a case, one of the home positions each defined on each side of the guide shaft 233 may be used for parking two or more carriages.

Figure 24:
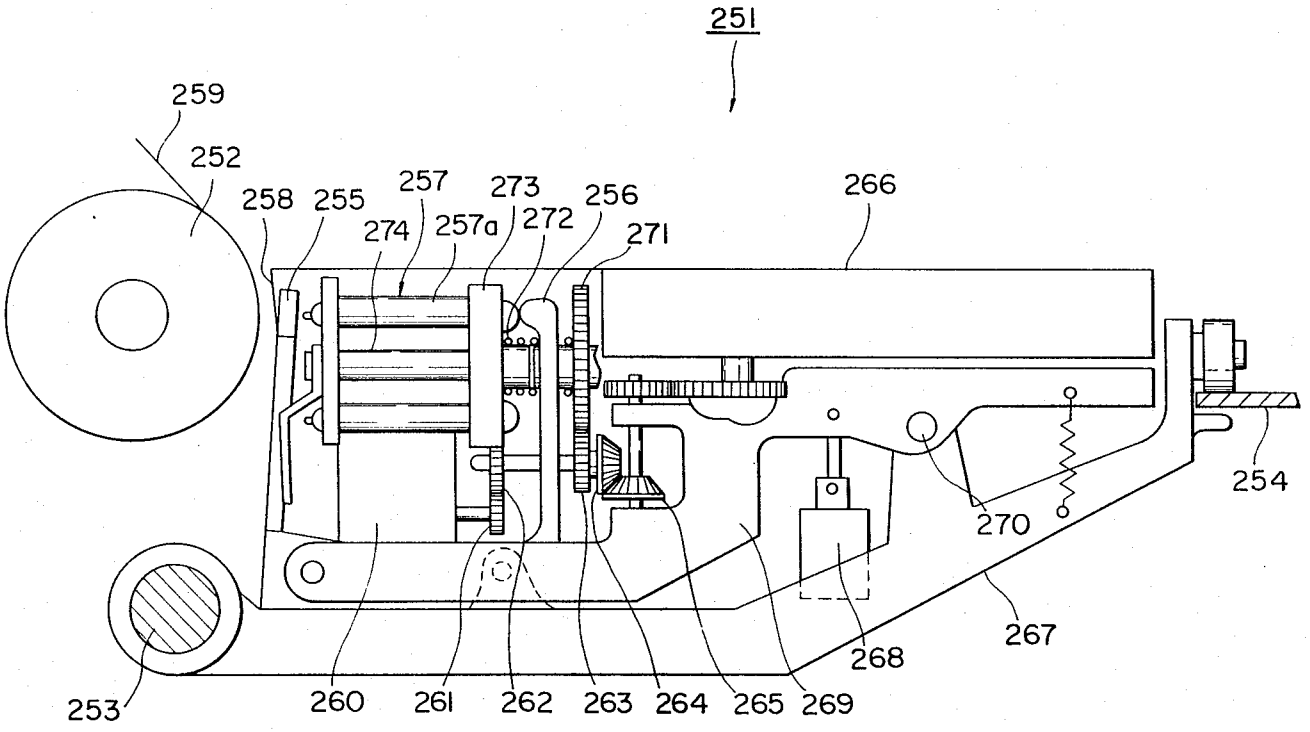
FIGS. 24 and 25 are schematic illustrations showing a still further embodiment of the present invention in which provision is made of a thermal print head and pen print head.
Figure 25:
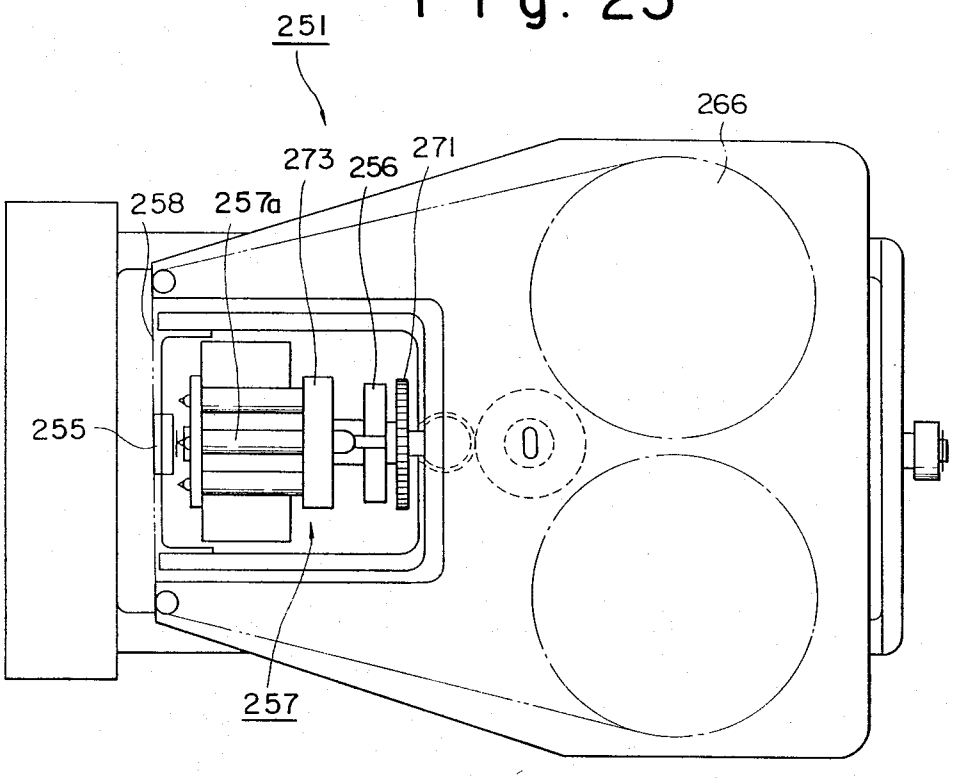

FIGS. 24 and 25 illustrate a hybrid printer including a thermal print head and a pen print head constructed in accordance with another embodiment of the present invention. As shown, this hybrid printer includes a carriage 251 which is slidably supported on a support shaft 253 and a guide plate 254 so as to be movable along a platen roller 252 in a reciprocating manner. On the carriage 251 is mounted a thermal print head 255 facing the platen roller 252, which may be pressed against a sheet of paper 259 on the platen roller 252 with ink ribbon interposed between the sheet 259 and the thermal print head 255.

Behind the thermal print head 255 is disposed a ball-point pen print head 257 including a plurality of pens and an actuator lever 256. The thermal print head 255 is normally biased to move away from the platen roller 252, for example, by means of a spring (not shown) thereby causing the head 255 to be in engagement with a stopper (not shown) to be located at a position so as not to be in contact with the ink ribbon 258. In the illustrated embodiment, the pen print head 257 includes four pens different in color from one another as securely held by a mounting structure 273. The mounting structure 273 is rotatably supported on a supporting shaft 274 and a selected one of the pens is located at a predetermined printing position where the acutator lever 256 may engage with the selected pen. For this purpose, there is typically provided a sensor (not shown) for detecting the rotary position of the mounting structure 273.

Also mounted on the carriage 251 is a step motor 260 which is operatively coupled to an ink ribbon feed gear (not shown) of an ink ribbon cassette 266 through a gear train including a drive gear 261, idler gears 262, 263 and 264, and bevel gears 264 and 265. The step motor 260 is also operatively coupled to the mounting structure 273 through another power transmission route including the drive gear 261, idler gears 262 and 263, pen selection gear 271 and clutch spring 272. And thus the mounting structure 273 may be driven to rotate around the support shaft 274 by the step motor 260. The carriage 251 also includes a lower carrier 267, an upper carrier 269 which is pivotally supported on the bottom carrier 267 at a pivot 270 and a solenoid 268 interposed between the lower and upper carriers 267 and 269. Thus, when the solenoid 268 is energized, the upper carrier 269 is forced to pivot counterclockwise around the pivot 270 so that the thermal print head 255 mounted on the upper carrier 269, together with the ribbon cassette 266, is moved downward, thereby allowing the pen 257*a* located at a predetermined printing position to be exposed to the sheet of paper 259.

In operation, during a print mode using the thermal print head 255, the solenoid 268 remains deenergized so that the upper carrier 269 takes the upper position thereby locating the thermal print head 255 at a predetermined print position of the carriage 251. Under the condition, when the actuator lever 256 is pivotted counterclockwise by means of a solenoid (not shown), the actuator lever 256 causes the pen 257*a* to move toward the platen roller 252 thereby having the thermal print head 255 pressed against the sheet of paper 259 on the platen roller 252 with the ink ribbon 258 sandwiched between the head 255 and the sheet of paper 259 due to engagement between the head 255 and the pen 257*a*. Under the condition, by moving the carriage 251 along the platen roller 252 by selectively activating a matrix of heat-producing elements provided at the front surface of the head 255 in accordance with a print signal supplied thereto, printing may be effected to the sheet of paper 259. During carriage return or while no printing is carried out, the acutator lever 256 is held at its retracted position so that the thermal print head 255 is located at a position separated away from the platen roller 252. The feeding of ribbon 258 is carried out by driving the step motor 260 to rotate in the ribbon feeding direction through a power transmission line including the drive gear 261, idler gears 262 and 263, bevel gears 264 and 265 and the feed gear provided inside of the ribbon cassette 266. Under the condition, the power is not transmitted to the mounting structure 273 because the selection gear 271 rotates in the decoupling direction with respect to the clutch spring 272.

On the other hand, during a printing mode using the pen print head 257, the solenoid 267 is energized to have the upper carrier 269 located at its lower position so that the thermal print head 255, together with the ink ribbon 258, is located below the pen 257*a*. Then the step motor 260 is driven to rotate in the reversed direction to rotate the mounting structure 273 around the shaft 274 to locate the pen 257*a* having desired color at a predetermined printing position. In this case, the power is transmitted from the motor 260 to the mounting structure 273 through the drive gear 261, idler gears 262 and 263, selection gear 271 and clutch spring 272. Under the circumstances, the bevel gear 264 is decoupled from the bevel gear 265 since the upper carrier 269 is located at its lower position, and, thus, no power is transmitted to the feed gear of the ribbon cassette 266. Then, when the actuator lever 256 is pivotted counterclockwise, the pen 257*a* is pushed forward to be brought into contact with the sheet of paper 259 on the platen roller 252. Under the condition, graphic printing may be carried out by the pen 257*a* by moving the carriage 251 along the platen roller 252 and rotating the platen roller 252 in either direction.

Figure 26:
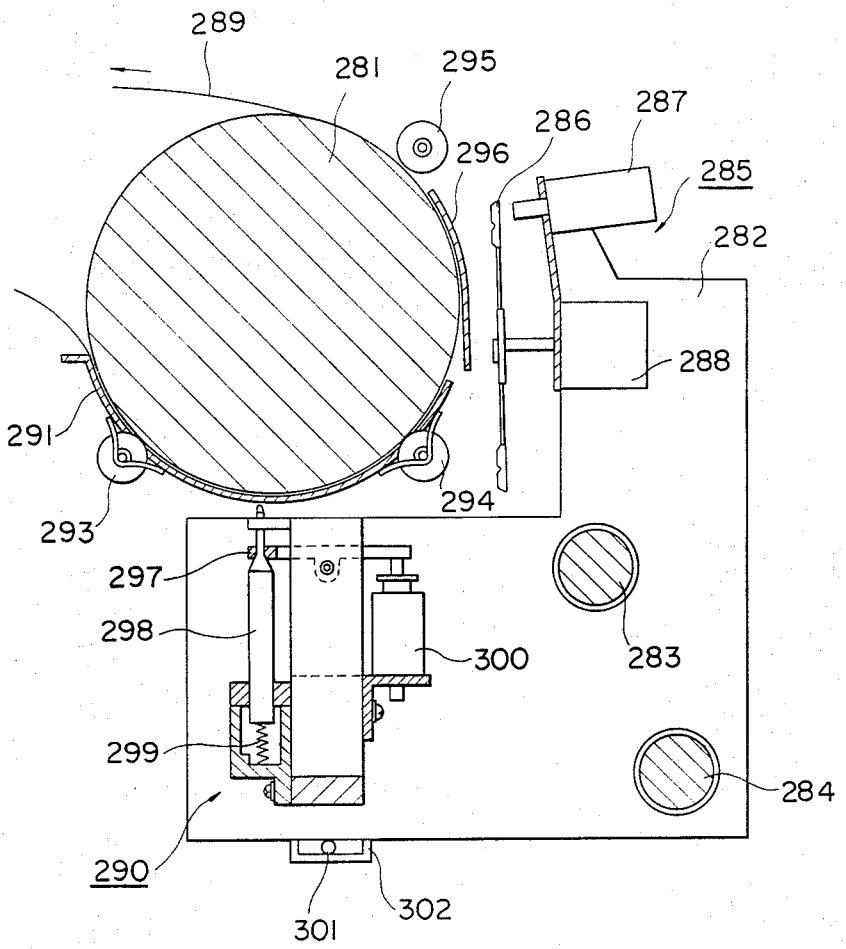
FIGS. 26 through 28 are schematic illustrations showing a still further embodiment of the present invention in which the type wheel print head and the pen print head are arranged as aligned in the longitudinal direction of the platen roller and spaced apart from each other in the circumferential direction thereof.
Figure 27:
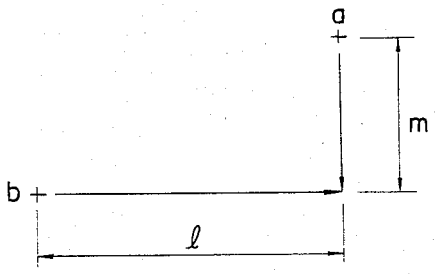
Figure 28:
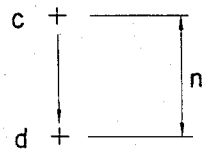

FIG. 26 shows a hybrid printer which is constructed in accordance with a still further embodiment of the present invention. As shown, the hybrid printer includes a platen roller 281 and a carriage 282 which is slidably supported on a pair of upper and lower guide shafts 283 and 284 so as to be reciprocatingly movable along the platen roller 281. There is provided a driving wire 301 which also extends generally along the platen roller 281 and which is connected to a carriage drive motor (not shown). The driving wire 301 is fixedly attached to the carriage 282 by a wire clamp 302 provided at the bottom of the carriage 282. On the carriage 282 is mounted a type wheel print head 285 and a pen print head 290 such that their head or printing positions are aligned on a plane which is perpendicular to the longitudinal axis of the platen roller 281. That is, as shown in FIG. 28, in the structure of FIG. 26, the head or printing position c of the type wheel print head 285 and the head or printing position d of the pen print head 290 are arranged such that they are aligned in the space direction but separated from each other over a distance n in the line feed direction. This is the critical difference from the previous embodiments in which the head positions a and b of two print heads different in type are arranged such that they are separated over a distance l in the space direction and over a distance m in the line feed direction, as shown in FIG. 27.

The type wheel print head 285 includes a type wheel 286, a selection motor 288 for supporting the type wheel 286 rotatably and a hammer assembly 287 for applying an impact force to a selected type located at a predetermined printing position, which is typically the uppermost position of type wheel 286. As shown in FIG. 26, the head or printing position of the type wheel print head 285 is defined at a location which is slightly above the center of an upper paper guide 296 which in turn is disposed along and with a predetermined gap from the platen roller 281. Also disposed along the platen roller 281 is a lower paper guide 291 for guiding the motion of a sheet of paper 289. A plurality of pressure rollers 293, 294 and 295 are also provided appropriately around the platen roller 281 for keeping the sheet of paper 289 in contact with the platen roller 281.

The pen print head 290 includes a ball-point pen 298 oriented with its ball-point end directed toward the platen roller 281, a compression spring 299 disposed in contact with the rear end of the pen 298 so as to apply a bias force tending to move the pen 298 toward the platen roller 281, a pivotally supported actuator lever 297 provided with a notch at its one end to hold the forward portion of the pen 298 and a solenoid 300 coupled to the other end of the actuator lever 297 so as to control the pivotal position of the actuator lever 297. The head or printing position of the pen print head 290 is defined between the pressure rollers 293 and 294. It is to be noted that although not shown specifically, each of the paper guides 291 and 296 is formed with a hole through which printing can be effected to the sheet of paper 289 on the platen roller 281 by the corresponding one of the print heads 285 and 290.

With the above-described structure, if printing is to be carried out by the pen print head 290 after printing by the type wheel print head 285, it is only necessary to rotate the platen roller 281 over an angle corresponding to the distance n and it is not necessary to move the carriage 282 along the platen roller 281 in the space direction.

Figure 29:
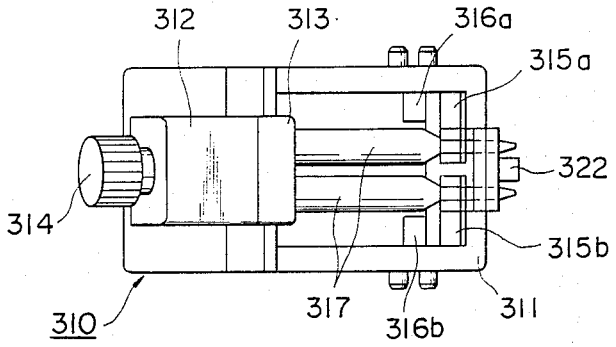
FIGS. 29 and 30 are schematic illustrations showing a pen print head which is constructed in accordance with one embodiment of the present invention.
Figure 30:
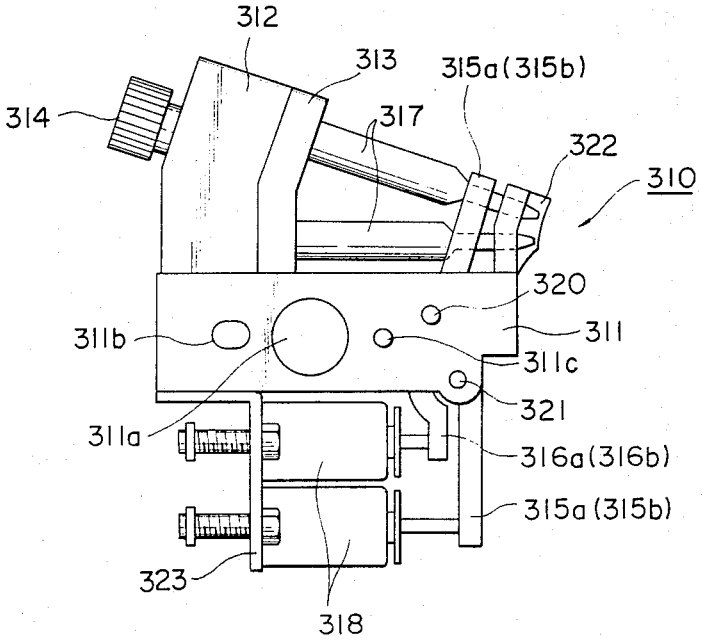

FIGS. 29 and 30 show in detail a pen print head 310 which may be advantageously applied to any of the above-described hybrid printers. As shown, the pen print head 310 includes a base 311 which can be fixedly attached to a carriage as arranged side-by-side, for example, by means of screws inserted through mounting holes 311*b* and 311*c*. It is to be noted that the mounting hole 311*c* is circular in cross-sectional shape but the other mounting hole 311*b* is slot-shaped and little larger than the hole 311*c*. Thus, the block 311 may be pivotted around the axis of hole 311*c* slightly, which allows to facilitate the mounting of the block 311 to the carriage. The block 311 is also provided with a center hole 311*a* into which a guide shaft may be slidably fitted. As described before, the guide shaft also supports the carriage slidably.

A holding plate 313 is integrally provided on the base 311 and a paper guide 322 is also integrally provided on and at the front end of the base 311. The holding plate 313 and paper guide 322 are provided with suitable holes through which ball-point pens 317, four in the illustrated example, may be supported in position. A cover 312 may be set in position in contact with the holding plate 313 and the base 311 and it may be secured in position by tightening a knob 314. Although not shown, it should be understood that compression springs are provided in the cover 312, one for each of the pens 317, thereby applying a bias force tending to move the pens 317 forward. Also provided are four actuator levers 315*a*, 315*b*, 316*a* and 316*b*, one for each of the pens 317, which are pivotally supported on the base at pivots 320 and 321. The top end of each of the actuator levers 315*a*, 315*b*, 316*a* and 316*b* is provided with a notch in which the forward end portion of the corresponding pen 317 can be fitted. On the other hand, the bottom end of each actuator lever is operatively coupled to a corresponding one of four solenoids 318 which are fixedly attached to the base 311 through a bracket 323.

With this structure, when one of the solenoids 318 is energized, the corresponding acutator lever 315*a*, 315*b*, 316*a* or 316*b* is pivotted clockwise around the corresponding pivot 320 or 321 so that the corresponding pen 317 is pushed forward due to the bias force applied by the spring provided inside of the cover 312. When the pen 317 is so located at its advanced position, its tip end or ball-point end is located in front of the front surface of the paper guide 322 thereby allowing the ball-point end of the thus selected pen 317 to be in contact with a sheet of paper to be printed. Thus, when the pen 317 is located at its retracted position, its ball-point end is positioned behind the front surface of the paper guide 322. Accordingly, when the pens 317 are retracted, their ball-point ends are prevented from coming into contact with the sheet of paper moving between the paper guide 322 and the platen roller.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A printer for printing graphic information as well as character information selectively, comprising:

a housing;

a platen roller rotatably supported in said housing;

first driving means for driving said platen roller to rotate it;

a plurality of printing means supported to be movable independently from one another along said platen roller in a reciprocating manner;

second driving means for driving at least one of said printing means to move it along said platen roller;

coupling means for selectively coupling at least one of said printing means to said second driving means; and control means connected to said first and second driving means, said plurality of printing means and said coupling means for controlling the operation of said printer, wherein said second driving means includes a transmitting member disposed along said platen roller and a driving motor for driving said transmitting master in either direction, and said coupling means includes at least one magnetic element fixedly attached to said transmitting member and a plurality of electromagnet units each fixedly provided in a corresponding one of said printing means, one of said plurality of electromagnet units being selectively energized by said control means to be coupled to said magnetic element.

2. The printer of claim 1 further including a guide shaft on which a first printing means and a second printing means of said plurality of printing means are slidably mounted, said guide shaft having defined, at extreme ends thereof, respective first and second home positions for said first and second printing means.

3. The printer of claim 2 wherein each of said first and second printing means is latched into a corresponding one of said home positions when not in use.

4. The printer of claim 1 wherein each of said plurality of printing means is provided with a recess matching one of said magnetic elements.

5. The printer of claim 1 in which said printing means comprise print heads.

6. The printer of claim 5 in which said transmitting member comprises an endless belt parallel to the platen roller.

7. The printer of claim 1 in which said transmitting member comprises an endless belt parallel to the platen roller.

* * * * *